US009768485B2

(12) United States Patent
Cho et al.

(10) Patent No.: US 9,768,485 B2
(45) Date of Patent: Sep. 19, 2017

(54) DUPLEXER

(71) Applicant: Innertron, Inc., Incheon (KR)

(72) Inventors: Hak Rae Cho, Incheon (KR); Soo Duk Seo, Incheon (KR); Jong Woo Ha, Seoul (KR); Moon Bong Ko, Incheon (KR)

(73) Assignee: INNERTRON, INC., Incheon (KR)

( * ) Notice: Subject to any disclaimer, the term of this patent is extended or adjusted under 35 U.S.C. 154(b) by 34 days.

(21) Appl. No.: 14/864,808

(22) Filed: Sep. 24, 2015

(65) Prior Publication Data

US 2016/0134005 A1 May 12, 2016

(30) Foreign Application Priority Data

Nov. 7, 2014 (KR) ..... 10-2014-0154395

(51) Int. Cl.
*H01P 5/12* (2006.01)
*H01P 7/04* (2006.01)
*H01P 1/213* (2006.01)

(52) U.S. Cl.
CPC ..... *H01P 7/04* (2013.01); *H01P 1/2136* (2013.01)

(58) Field of Classification Search
CPC ..... H01P 7/04; H01P 1/2136
USPC ..... 333/134
See application file for complete search history.

(56) References Cited

U.S. PATENT DOCUMENTS 6,806,791 B1 * 10/2004 Wang ..... H01P 1/2138 333/134

FOREIGN PATENT DOCUMENTS

| | | | |
|---|---|---|---|
| JP | 58-215803 | A | 12/1983 |
| JP | 2010-199790 | A | 9/2010 |
| KR | 10-0586321 | B1 | 1/2005 |

OTHER PUBLICATIONS

Korean Office Action dated Jan. 21, 2016, issued by the Korean Intellectual Property Office in corresponding application KR 10-2014-0154395.

* cited by examiner

*Primary Examiner* — Robert Pascal
*Assistant Examiner* — Kimberly Glenn
(74) *Attorney, Agent, or Firm* — Stein IP, LLC

(57) ABSTRACT

A duplexer includes a plurality of first resonators disposed along the transmission path of the transmitting signal; a plurality of second resonators disposed along the transmission path of the receiving signal; and a combining panel having an overlapped area between one of the plurality of first resonators which is disposed closest to an antenna and one of the plurality of second resonators which is disposed closest to the antenna, wherein each of said first resonators and said second resonators includes: a body comprised of dielectric material, and formed with a through hole penetrating unidirectionally, and a conducting layer formed on the cross-section of at least one side of the cross-sections of the both sides along the lengthwise direction of said body, and the surface of the wall of said through hole.

7 Claims, 5 Drawing Sheets

DUPLEXER

CROSS-REFERENCE TO RELATED PATENT APPLICATION

This U.S. non-provisional patent application claims priority under 35 U.S.C. §119 of Korean Patent Application No. 10-2014-0154395 filed on Nov. 7, 2014 in the Korean Intellectual Property Office, the entire contents of which are hereby incorporated by reference.

BACKGROUND

1. Technical Field

The exemplary embodiment according to the concept of the present invention relates to a duplexer, more particularly, relates to a duplexer including a combining panel having overlapping areas with the dielectric resonators neighboring with antenna in a structure having a plurality of dielectric resonators and a cavity for accommodating thereof.

2. Background Art

Various types of filters are used in the communication systems. Filter is a device which passes only the signals of a specific frequency band, and it is classified into a low pass filter (LPF), a band pass filter (BPF), a high pass filter (HPF), a band stop filter (BSF), and the like according to the filtering frequency band.

Also, it can be classified into an LC filter, a transmission line filter, a cavity filter, a dielectric resonator (DR) filter, a ceramic filter, a coaxial filter, a waveguide filter, a surface acoustic wave filter, and the like according to the manufacturing method thereof and the elements used therein.

In order to simultaneously implement the narrow bandwidth and the superior band stop characteristics in a filter, a high Q-factor resonator is required. In this case, resonators are mostly implemented in a PCB type, a dielectric type, or a mono-block type resonator.

Especially, a duplexer is used as an element which separates the transmission frequency and the receiving frequency, and above all, a duplexer structure that can simultaneously implement a narrow bandwidth and a superior frequency cutoff characteristics is required.

SUMMARY

A technical objective of the present invention is to provide a duplexer having a narrow bandwidth and a superior cutoff characteristics by including an integrated panel having overlapping areas with the dielectric resonators neighboring with antenna in a structure having a plurality of dielectric resonators and a cavity for accommodating thereof.

The duplexer according to an exemplary embodiment of the present invention includes: a plurality of first resonators disposed along the transmission path of the transmitting signal; a plurality of second resonators disposed along the transmission path of the receiving signal; and a combining panel having an overlapped area between one of the plurality of first resonators which is disposed closest to an antenna and one of the plurality of second resonators which is disposed closest to the antenna, wherein each of said first resonators and said second resonators includes: a body comprised of dielectric material, and formed with a through hole penetrating unidirectionally, and a conducting layer formed on the cross-section of at least one side of the cross-sections of the both sides along the lengthwise direction of said body, and the surface of the wall of said through hole.

According to the exemplary embodiment of the present invention, the combining panel may be connected to an antenna connector through a connecting pin made for combining the antenna thereto.

According to the exemplary embodiments of the present invention, the duplexer may further include: a substrate, coupled with the cross-section of at least one side of the both sides of each of the first resonators and the second resonators respectively, and performing ground function, and a housing coupled to the substrate and accommodating the first resonators and the second resonators.

According to the exemplary embodiments of the present invention, the combining panel may be connected to the substrate through a plurality of fixing units.

According to the exemplary embodiments of the present invention, the combining panel may be disposed spaced apart from the substrate.

According to the exemplary embodiments of the present invention, the combining panel may be connected to the substrate through a fixing unit.

According to the exemplary embodiments of the present invention, the fixing unit may have an overlapped region with any one of the first resonators and the second resonators.

According to the exemplary embodiments of the present invention, the duplexer may further include: a transmission connector which transmits the transmitting signal to the antenna through the first resonators, and a receiving connector which receives the receiving signal from the antenna through the second resonators, wherein the transmission connector and the receiving connector may be disposed in the opposite side of the antenna disposed in one side of the housing.

DETAILED DESCRIPTION OF EMBODIMENTS

Figure 1:
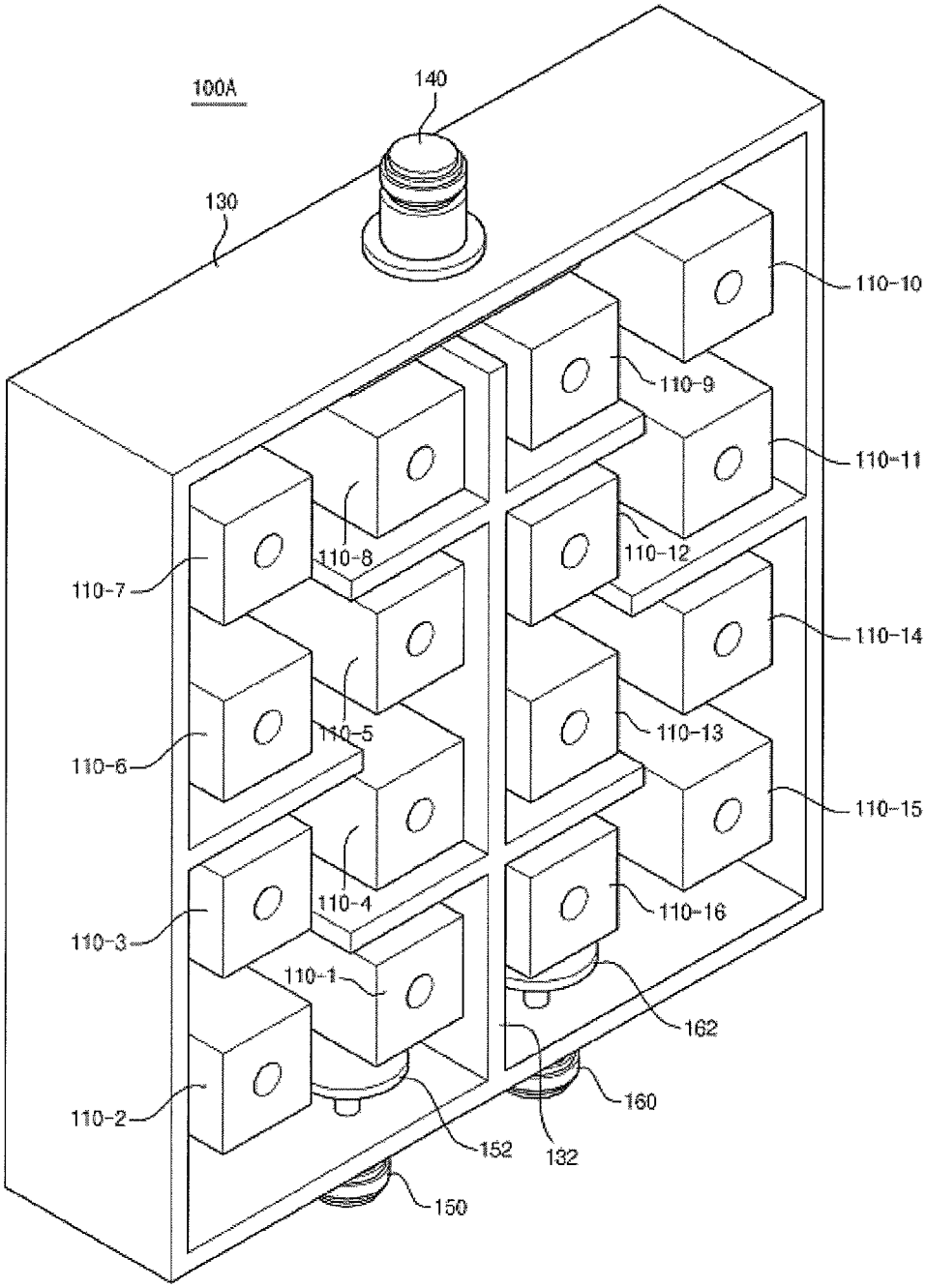
FIG. 1 is a perspective view of a duplexer according to an exemplary embodiment of the present invention.

While a specific structural or functional description with respect to embodiments according to the present invention disclosed in this specification is merely provided for the purpose of describing the embodiments of the present invention, there are various modifications capable of replacing the embodiments, and the present invention is not limited to the embodiments described in this specification.

While the embodiments according to the present invention is susceptible to various modifications and alternative forms, specific embodiments thereof are shown by way of examples in the drawings and will herein be described in detail. It should be understood, however, that there is no intent to limit the present invention to the particular forms disclosed, but on the contrary, the present invention is to cover all modifications, equivalents, and alternatives falling within the spirit and scope of the invention.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the inventive concept.

It will be understood that when an element is referred to as being "connected" or "coupled" to another element, it can be directly connected or coupled to the other element or intervening elements may be present. In contrast, it will be understood that when an element is referred to as being "directly connected" or "directly coupled" to another element, there are no intervening elements present. Other expressions describing a relation between elements, that is, "~between" and "directly~between", or "adjacent to~" and "directly adjacent to~", etc. should be similarly understood.

The terminology used herein is for the purpose of describing particular embodiments only and is not intended to be limiting of the invention. As used herein, the singular forms "a", "an," and "the" are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms used herein including the technical or scientific terms have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
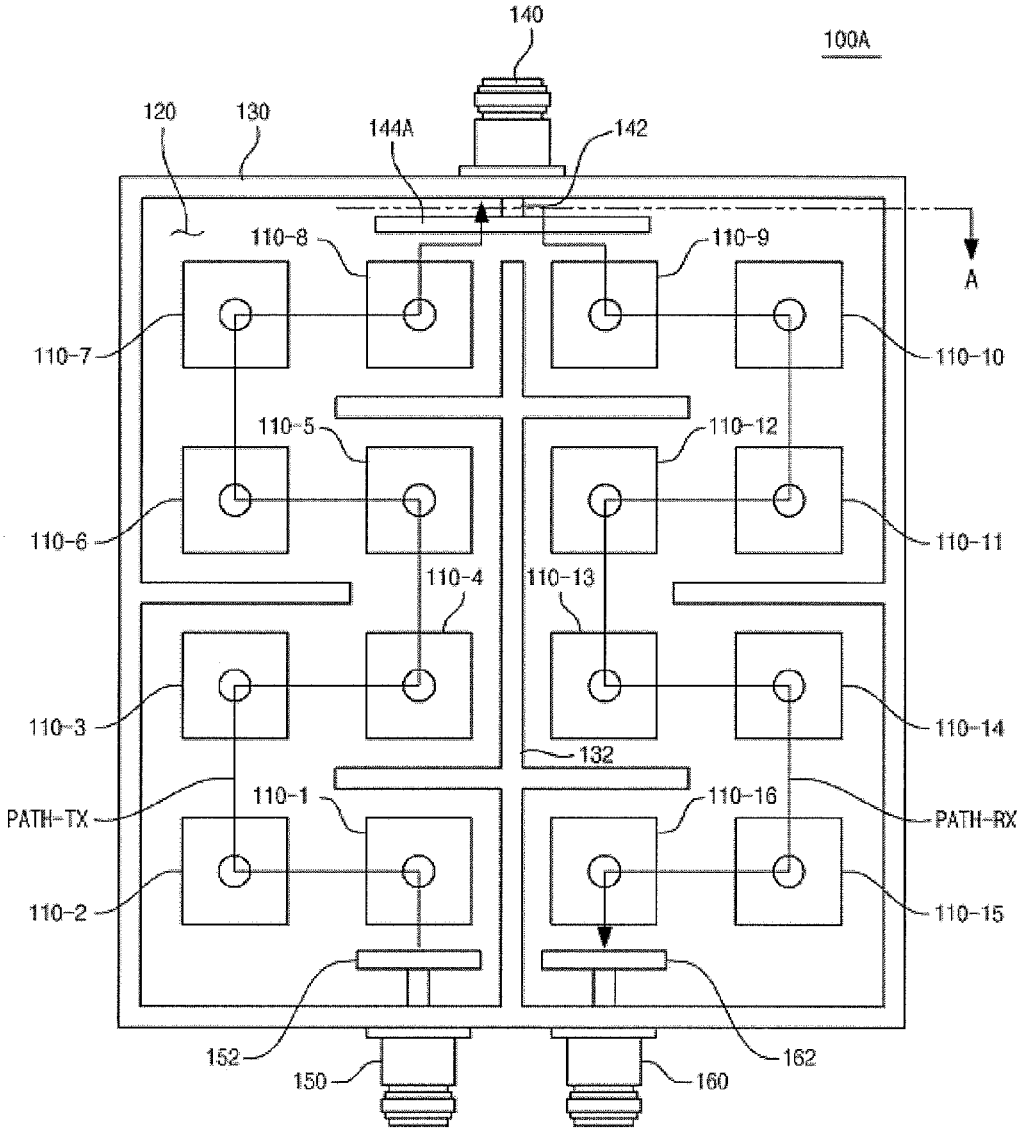
FIG. 2 is a plan view of the duplexer illustrated in FIG. 1.

FIG. 1 is a perspective view of a duplexer according to an exemplary embodiment of the present invention. FIG. 2 is a plan view of the duplexer illustrated in FIG. 1.

Referring to FIGS. 1 and 2, a duplexer 100A according to an exemplary embodiment of the present invention may include: a plurality of first resonators 110-1 to 110-8; a plurality of second resonators 110-9 to 110-16; a substate 120; a housing 130; an isolation wall 132; an antenna connector 140; a connecting pin 142; a combining panel 144A; a transmission connector 150; a first coupling element 152; a receiving connector 160; and a second coupling element 162.

The first resonators 110-1 to 110-8 are disposed on the path of the transmission signal of the duplexer 100A, and combined on the substrate 120, and may be accommodated inside the housing 130.

The second resonators 110-9 to 110-16 are disposed on the path of the receiving signal of the duplexer 100A, and combined on the substrate 120, and may be accommodated inside the housing 130.

According to the exemplary embodiment, the pass band of the transmission filter and the pass band of the receiving filter may be different.

The first resonators 110-1 to 110-8 and second resonators 110-9 to 110-16 may be implemented with an identical structure, and the structure of each of the first resonators 110-1 to 110-8 and second resonators 110-9 to 110-16 will be described in detail with reference to FIG. 4.

According to the exemplary embodiment, the first resonators 110-1 to 110-8 and second resonators 110-9 to 110-16 may be implemented in a way that the sizes or the proportions thereof are different from each other.

The substrate 120 may perform the ground function being electrically connected to each of the first resonators 110-1 to 110-8 and second resonators 110-9 to 110-16.

According to the exemplary embodiment, the first resonators 110-1 to 110-8 and second resonators 110-9 to 110-16 may be connected with the substrated 120 through electoplating.

According to the exemplary embodiment, the substrate 120 may be implemented with a printed circuit board (PCB) which includes a conductive pattern in order to perform the ground function.

Inside the housing 130, a cavity divided by a plurality of insulation walls 132 may be included, and the first resonators 110-1 to 110-8 and second resonators 110-9 to 110-16 may be accommodated inside the cavity. The layout of the insulation walls 132 can be modified in various ways, and the signal pathway inside the housing 130 may be changed according to the layout of the insulation walls 132.

Although the housing 130 is illustrated in the shape of a rectangular parallelepiped, but it is not limited to this, and the technical scope of the present invention should not be limitedly interpreted due to the shape of the housing 130.

According to the exemplary embodiment, the exterior or the interior of the housing 130 may be electroplated with a conductive material {for example, silver (Ag) or copper (Cu), etc.}.

The housing 130 is combined with the substrate 120 disposed in the lower portion of the housing 130, and can accommodate the first resonators 110-1 to 110-8 and second resonators 110-9 to 110-16.

In one side of the housing 130, an antenna connector 140 may be provided.

The antenna connector 140 is connected with the antenna (not shown) and enables the duplexer 100A to transmit and receive the signal in a bidirectional way.

The connecting pin 142 is connected between the antenna connector 140 and the combining panel 144A, and can transfer the signal between the antenna connector 140 and the combining panel 144A.

The first resonator 110-8 is the resonator closest to the antenna (not shown), among the first resonators 110-1 to 110-8 disposed on the pathway of the transmission signal (PATH-TX), that is, the resonator closest to the antenna connector 140 being connected to the antenna (not shown) in FIGS. 1 and 2.

And, the second resonator 110-9 is the resonator closest to the antenna (not shown), among the second resonators 110-9 to 110-16 disposed on the pathway of the receiving signal (PATH-TX), that is, the resonator closest to the antenna connector 140 being connected to the antenna (not shown) in FIGS. 1 and 2.

The combining panel 144A may have an overlapping area with the first resonator 110-8 and second resonator 110-9. For example, the combining panel 144A may have an overlapping area with the first resonator 110-8 and second resonator 110-9 along the direction of signal propagation.

The combining panel 144A can effectively transfer the transmission signal transmitted through the transmission connector 150 and the first resonators 110-1 to 110-8 to the antenna connector 140 via the area being overlapped with the first resonator 110-8.

The combining panel 144A can effectively transfer the received signal transmitted through the antenna connector 140 and the connecting pin 142 to the second resonator 110-9 via the area being overlapped with the second resonator 110-9.

According to the exemplary embodiment, the location and the area, wherein the combining panel 144A, the first resonator 110-8, and second resonator 110-9 are being overlapped respectively, may be changed.

The transmission connector 150 can input signals within a specific frequency range to the duplexer 100A. According to an exemplary embodiment of the present invention, a signal processing circuit (for example, band pass filter circuit) may be included in the transmission connector 150, or connected to the signal processing circuit. For example, the signal processing circuit may include a radio frequency (RF) circuit configured for signal processing.

The coupling device 152 can transfer the signal inputted via the transmission connector 150 to the first resonator 110-1.

The receiving connector 160 can output the signals within a specific frequency range from the duplexer 100A. According to an exemplary embodiment of the present invention, a signal processing circuit (for example, band pass filter circuit) may be included in the receiving connector 160, or connected to the signal processing circuit. For example, the signal processing circuit may include a radio frequency (RF) circuit configured for signal processing.

The second coupling device 162 can transfer the signal transmitted from the second resonator 110-16 to the receiving connector 160.

The number and the layout of the first resonators 110-1 to 110-8 and second resonators 110-9 to 110-16 illustrated in FIGS. 1 and 2 are merely an exemplary embodiment, and may be changed depending on the frequency pass band and the bandwidth of each of the transmission and the receiving signals of the duplexer 100A respectively.

The antenna (not shown) may be disposed in the same side with the antenna connector 140 since it is connected to the antenna connector 140 disposed in one side of the housing 130, and the transmission connector 150 and the receiving connector 160 may be disposed in the opposite side of the antenna (not shown), that is, the opposite side of the antenna connector 140.

Figure 3:
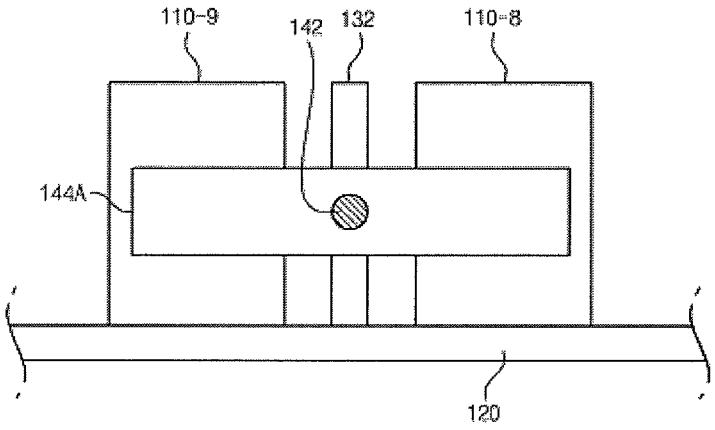
FIG. 3 is a drawing showing the combining panel viewed from the cross-section A illustrated in FIG. 2.

FIG. 3 is a drawing showing the combining panel viewed from the cross-section A illustrated in FIG. 2. FIG. 4 is a perspective view of the duplexer illustrated in FIG. 2.

Figure 4:
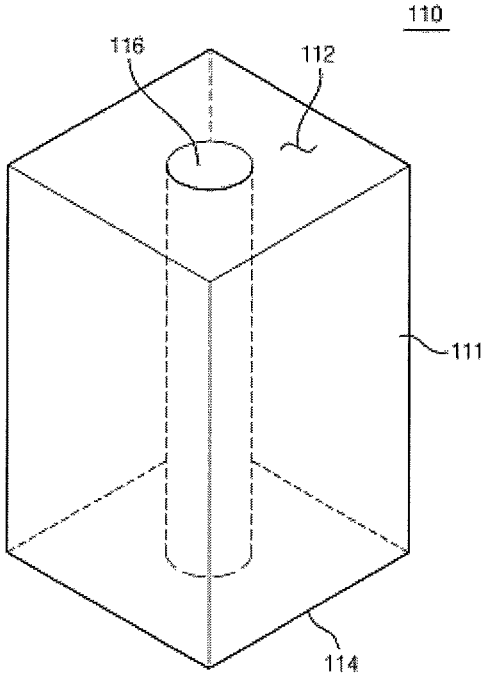
FIG. 4 is a perspective view of the duplexer illustrated in FIG. 2.

Referring to FIGS. 2 to 4, the combining panel 144A may have an overlapped region with the first resonator 110-8 and the second resonator 110-9.

The combining panel 144A can be connected to the antenna 140 through the connecting pin 142. According to the exemplary embodiment, the combining panel 144A may be disposed spaced apart from the substrate 120, and implemented with a conductor.

Referring to FIG. 4, each resonator 110, for example, each of the first resonators 110-1 to 110-8 and second resonators 110-9 to 110-16 may include a body 111 comprising dielectric material (for example, ceramic and the like).

According to the exemplary embodiment, the body 111 may be implemented to have various shapes like a circular column, an elliptical column, and the like including a rectangular column.

A through hole 116 may be formed along the one direction of the body 111. For example, the through hole 116 may be formed along the lengthwise direction of the body 111, that is, along the direction of the longest side in the body 111.

According to an exemplary embodiment, a conductive layer may be formed on the cross-section of at least one side of the cross-sections 112 and 114 of the body 111.

According to another exemplary embodiment, a conductive layer (for example, a conductive layer formed with silver plating or copper plating) may be formed on the inner surface of the through hole 116 by electroplating.

The lower cross-section 114 of the body 111 can be connected with the substrate 120, that is, grounded through electroplating.

The other surfaces except the cross-sections 112 and 114 of the body 111 along the lengthwise direction thereof may not be treated by electroplating.

According to such structure, each resonator 110-1 to 110-3 can be operated in transverse electromagnetic (TEM) mode.

Figure 5:
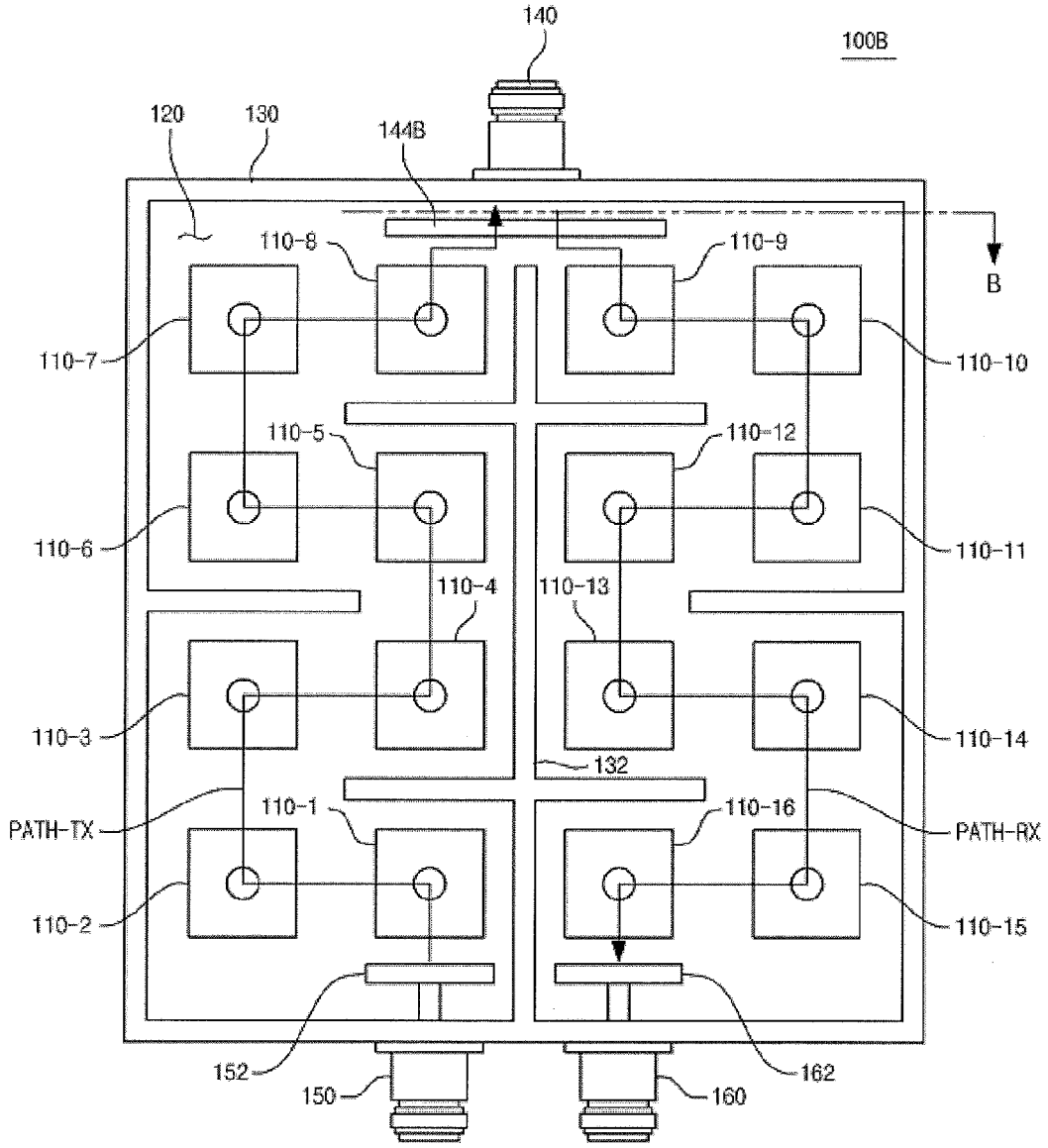
FIG. 5 is a plan view of a duplexer according to another exemplary embodiment of the present invention.

FIG. 5 is a plan view of a duplexer according to another exemplary embodiment of the present invention.

Referring to FIGS. 1 and 5, the structure of the duplexer 100B of FIG. 5 except the connecting structure (or fixed structure) of the combining panel 144B has practically same structure as that of the duplexer 100A of FIG. 2.

The combining panel 144B may be disposed spaced apart from the housing 130.

The connecting structure of the combining panel 144B will be described in detail with reference to FIGS. 6 and 7.

Figure 6:
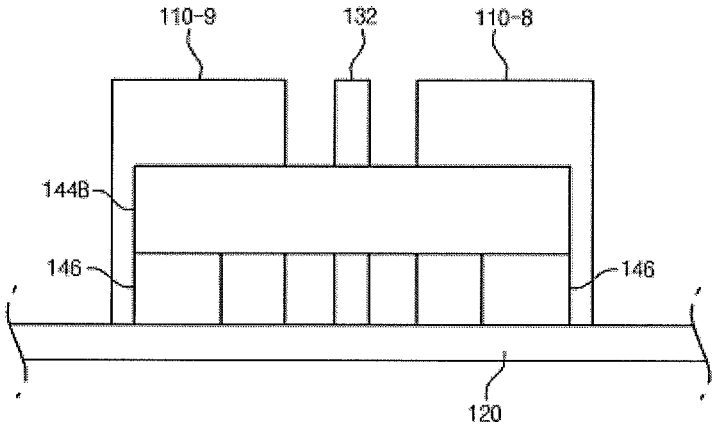
FIG. 6 is a drawing showing an exemplary embodiment of the combining panel viewed from the cross-section B illustrated in FIG. 5.

FIG. 6 is a drawing showing an exemplary embodiment of the combining panel viewed from the cross-section B illustrated in FIG. 5.

Referring to FIGS. 5 and 6, the combining panel 144B is disposed spaced apart from the substrate 120, and may be connected to the substrate 120 through the plurality of the fixing units 146.

That is, combining panel 144B can be grounded to the substrate 120 through the plurality of the fixing units 146.

According to the exemplary embodiment, the location of the fixing units 146 may be changed in various ways.

Figure 7:
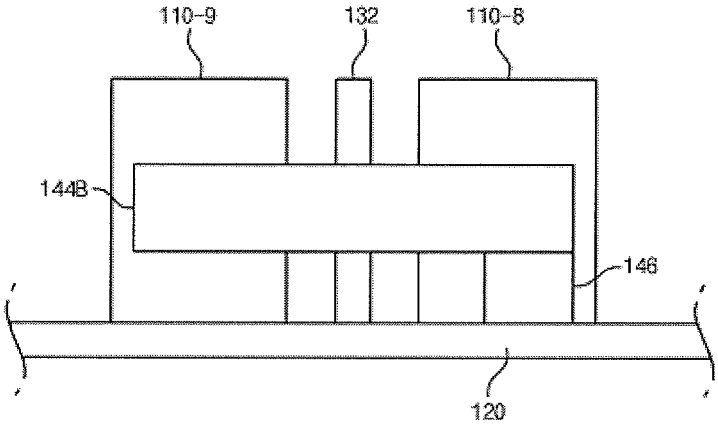
FIG. 7 is a drawing showing another exemplary embodiment of the combining panel viewed from the cross-section B illustrated in FIG. 5.

FIG. 7 is a drawing showing another exemplary embodiment of the combining panel viewed from the cross-section B illustrated in FIG. 5.

Referring to FIGS. 5 and 7, the combining panel 144B is disposed spaced apart from the substrate 120, and may be connected to the substrate 120 through the plurality of the fixing units 146.

That is, combining panel 144B can be grounded to the substrate 120 through a single fixing units 146.

In FIG. 7, although a structure wherein the fixing unit 146 has an overlapped area with the first resonator 110-8, the fixing unit 146 may have an overlapped area with the second resonator 110-9, according to the exemplary embodiment.

According to another exemplary embodiment, the fixing unit 146 may not have an overlapped area with each of the first resonator 110-8 and the second resonator 110-9 respectively. For example, the fixing unit 146 may be connected to the center of the combining panel 144B.

Although the combining panel 144B and the fixing unit 146 are configured to have a separated form in FIGS. 6 and 7 for the convenience of description, the combining panel 144B and the fixing unit 146 may be configured to have an integrated form according to the exemplary embodiment.

Although the present invention has been described with reference to the exemplary embodiments as illustrated in the drawings, this is merely for illustrative purposes, those skilled in the art will appreciate that various modifications and other equivalent embodiments are possible from these exemplary embodiment. Thus the true technical scope of the present invention must be defined only by the spirit of the appended claims.

An apparatus according to an exemplary embodiment of the present invention has an effect that not only the loss factor is low during the signal transmission process but also has a narrow bandwidth characteristic and a superior cutoff characteristic by including a combining panel having an overlapping area with the resonators disposed close to the antenna, in a structure having a plurality of resonators and a cavity accommodating these resonators.

Besides, an apparatus according to an exemplary embodiment of the present invention may have an effective structure for the corresponding frequency region by changing the shape of the combining panel depending on the frequency region for transmitting and receiving the signal.

DESCRIPTION OF SYMBOLS

100A, 100B: duplexer
110-1 to 110-16: resonator
120: substrate
130: housing
140: antenna connector
144A, 144B: combining panel
150: transmission connector
160: receiving connector

What is claimed is:

1. A duplexer including:

a plurality of first resonators disposed along a transmission path of a transmitted signal;

a plurality of second resonators disposed along a transmission path of a received signal;

a substrate configured to be grounded; and a combining panel having an overlapped area between one of the plurality of first resonators disposed closest to an antenna and one of the plurality of second resonators disposed closest to the antenna, wherein each of the plurality of first resonators and the plurality of second resonators includes:

a body formed of dielectric material, and including a through hole penetrating the body unidirectionally from a top surface to a bottom surface of the body, and a conducting layer plated on an inner surface of the through-hole and at least one of the top surface and the bottom surface of the body, wherein the substrate is connected to the bottom surface of the body of each of the plurality of first resonators and the plurality of second resonators, and the combining panel is installed to be spaced apart from the substrate.

2. The duplexer according to claim 1, wherein the combining panel is connected to an antenna connector combining the antenna thereto through a connecting pin.

3. The duplexer according to claim 1, further including:

a housing coupled to the substrate and accommodating the plurality of first resonators and the plurality of second resonators.

4. The duplexer according to claim 3, wherein the combining panel is connected to the substrate through a plurality of fixing units.

5. The duplexer according to claim 3, wherein the combining panel is connected to the substrate through a fixing unit.

6. The duplexer according to claim 5, wherein the fixing unit has an overlapped region with any one of the plurality of first resonators and the plurality of second resonators.

7. The duplexer according to claim 3, further including:

a transmission connector configured to transmit the transmitted signal to the antenna through the plurality of first resonators, and a receiving connector configured to receive the received signal from the antenna through the plurality of second resonators, wherein the transmission connector and the receiving connector are disposed in a side opposite to the antenna disposed in one side of the housing.

* * * * *